US005909499A

United States Patent [19]

Tanabe

[11] Patent Number: 5,909,499

[45] **Date of Patent: *Jun. 1, 1999**

[54] SPEAKER WITH MAGNETIC STRUCTURE FOR DAMPING COIL DISPLACEMENT

[75] Inventor: Kei Tanabe, Iwaki, Japan

[73] Assignee: Alpine Electronics, Inc., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/901,115

[22] Filed: Jul. 28, 1997

Related U.S. Application Data

[63] Continuation of application No. 08/598,932, Feb. 9, 1996, abandoned.

[30] Foreign Application Priority Data

Feb. 17, 1995 [JP] Japan ..... 7-053507

[51] Int. Cl.[6] ..... H01R 25/00

[52] U.S. Cl. ..... 381/419; 381/412; 381/421

[58] Field of Search ..... 381/199, 194, 381/205, 192

[56] References Cited

U.S. PATENT DOCUMENTS 4,783,824 11/1988 Kobayashi ..... 381/195

*Primary Examiner*—Sinh Tran

*Attorney, Agent, or Firm*—Brinks Hofer Gilson & Lione

[57] ABSTRACT

A speaker including a magnetic circuit formed by an annular yoke and an annular magnet which are concentric around a central axis and face each other across a gap. The magnet includes an N pole region and an S pole region successively arranged along the central axis direction and divided by an imaginary boundary line. At rest, a first coil is positioned in the gap in the N pole region, and a second coil is positioned in the gap in the S pole region. When the coils are driven by an excessively large current, a portion of the first coil moves beyond the boundary line to enter the S pole region, thereby causing a gentle first damping force on the first coil to prevent an excessive displacement. Likewise, the excessive current causes the second coil to move beyond the boundary line to enter the N pole region, thereby causing a second damping force which is opposite in direction to the first damping force. The damping forces limit a displacement range of the coils such that a damper does not collide with the magnet and similarly, the lower end of a bobbin does not collide with a frame of the speaker, thereby preventing collision sounds. The damping forces also prevent excessive stretching or contraction of a suspension, thereby preventing sound distortions.

16 Claims, 8 Drawing Sheets

FIG. 4A2
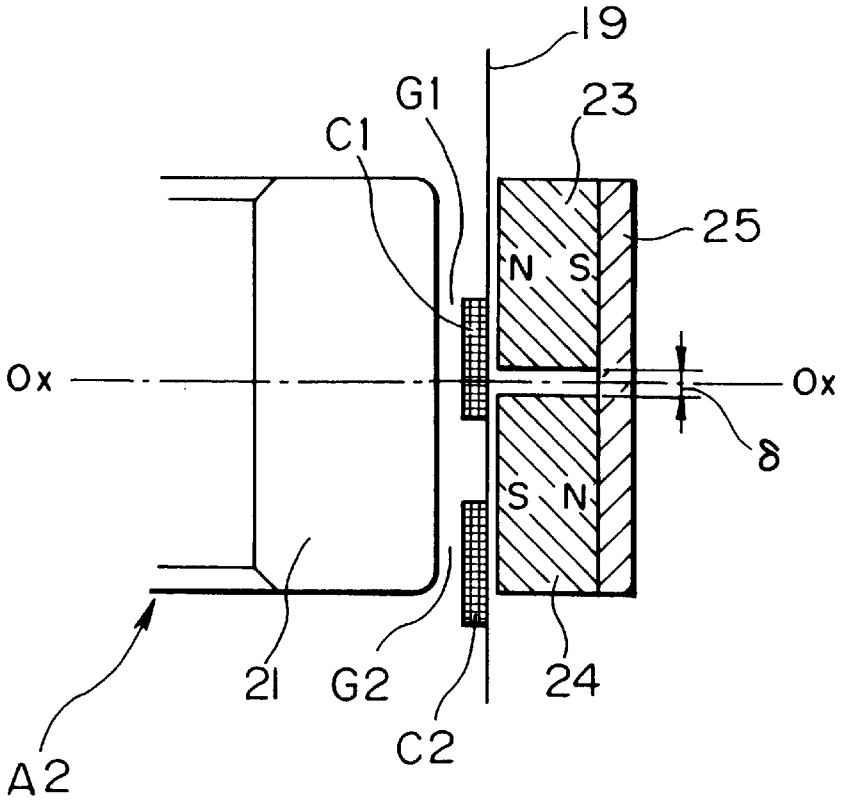
FIG. 4A1
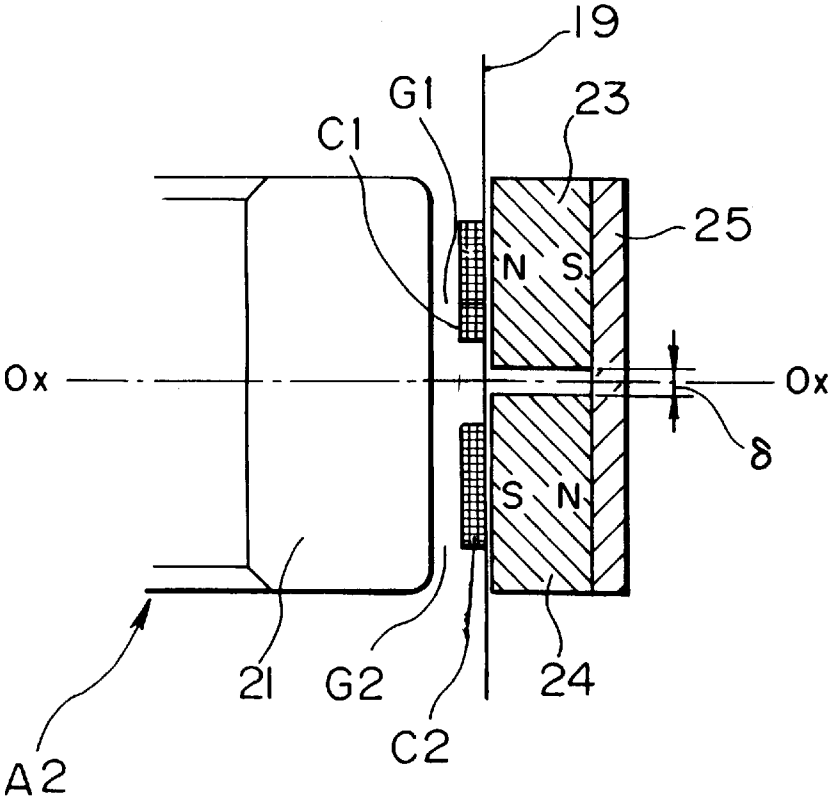

FIG. 4A3

SPEAKER WITH MAGNETIC STRUCTURE FOR DAMPING COIL DISPLACEMENT

This application is a continuation of application Ser. No. 08/598,932, filed Feb. 9, 1996, now abandoned.

BACKGROUND OF THE INVENTION

1. Field of the Invention

The present invention relates to a speaker having a diaphragm, a coil and a magnetic circuit, and more particularly, to a speaker which provides magnetic damping when amplitudes of the diaphragm and coil become large.

2. Description of the Related Art

FIG. 5 is a sectional view showing a conventional dynamic-type speaker typically used, for example, as a vehicle-mounted speaker; FIG. 6A is a sectional view showing a magnetic circuit of the conventional speaker; and FIG. 6B is a diagram showing the magnetic flux density produced in the magnetic circuit.

The conventional speaker shown in FIG. 5 includes a frame 1 made of metal, and a diaphragm 2 supported within the frame 1. The diaphragm 2 is cone-shaped and made of a paper material. A semispherical dome portion 3 is attached over an opening formed in a central portion 2*a* of the diaphragm 2. A suspension 4 is attached between the frame 1 and an outer portion 2*b* of the diaphragm 2. The suspension 4 is provided separately from the diaphragm 2 along the circumference of the edge of a outer portion 2*b* of the diaphragm 2. The suspension 4 includes a substantially semi-circular (semicylindrical) cross sectional configuration with a predetermined curvature. An inner edge of the suspension 4 is bonded to the diaphragm 2 and an outer edge is bonded to an outer edge 1*a* of the frame 1.

The outer periphery of the central portion 2*a* of the diaphragm 2 is supported by the frame 1 through a damper 5. The damper 5 is corrugated to form multiple ridges which are concentric about a central axis (Y-axis) of the speaker. An inner edge of the damper 5 is bonded to the central portion 2*a* of the diaphragm 2 and an outer edge thereof is bonded to the inner surface of the frame 1. The diaphragm 2 is supported by the suspension 4 and the damper 5 such that it can vibrate in the Y-axis direction.

A magnetic circuit A is provided between a bottom 1*a* of the frame 1 and the central portion 2*a* of the diaphragm 2. The magnetic circuit A is composed of a cylindrical yoke 6 made of a magnetic material, a ring-shaped magnet 7 positioned at the outer periphery of the yoke 6 and ring-shaped magnetic pole pieces 8*a* and 8*b* which joined to upper and lower ends of the magnet 7. The magnet 7 has magnetic anisotropy in the Y-axis direction such that a north (N) pole is formed near the upper end of the magnet 7 and a south (S) pole is formed near the lower end of the magnet 7. The yoke 6 and ring-shaped magnetic pole pieces 8*a* and 8*b* are formed of a material having a high magnetic permeability such as soft iron. Gaps G1 and G2 are respectively formed between the inner peripheral surfaces of the ring-shaped magnetic pole pieces 8*a* and 8*b* and the outer peripheral surfaces of the yoke 6.

A bobbin 9 is joined to the central portion 2*a* of the diaphragm 2 and extends into the gaps G1 and G2. Coils Cl and C2 are mounted on the bobbin 9 and are spaced apart in the Y-axis direction such that the coil Cl is positioned within the gap GI and the coil C2 is positioned within the gap G2.

The coils Cl and C2 are connected in series and wound such that they generate electromagnetic forces in the same direction when a predetermined voice current is applied thereto.

FIG. 6A shows an enlarged magnetic circuit A of the conventional speaker. As described above, in the conventional magnetic circuit A, the gaps G1 and G2 are respectively formed where ring-shaped pole pieces 8*a* and 8*b* face the yoke 6. Thus, within the widths W of the gaps G1 and G2, the magnetic flux density between the yoke 6 and the ring-shaped pole pieces 8*a* and 8*b* is high, and the magnetic flux density decreases substantially outside the widths W of the gaps G1 and G2, even when the distance outside the widths W is small.

FIG. 6B shows a change in the magnetic flux density in the Y-axis direction. It is apparent from this drawing that the magnetic flux density within the range of the widths W greatly differs from that in the range outside the widths W. When the coils C1 and C2 each having the width B in the Y-axis direction fall within the widths W of the gaps G1 and G2, the magnetic density crossing the coils C1 and C2 is substantially uniform, and a linear electromagnetic force acts on the coils.

However, as shown in FIG. 6B, substantially both ends of the widths W of the gaps G1 and G2 are sudden change points "a" where the magnetic flux density falls off suddenly. Therefore, as shown in FIG. 6A, when vibration of the diaphragm 2 causes the coils C1 and C2 to be located outside of the widths W of the gaps G1 and G2, a linearity of the electromagnetic force acting on the coils C1 and C2 is extremely deteriorated by an influence of the sudden change points "a", thereby causing sound distortion.

A vehicle-mounted speaker and the like is conventionally used for amplifying a radio sound and reproduced sound stored on a magnetic tape. Recently, however, these speakers have been used for reproducing music signals from sources such as compact discs (CDs).

In reproducing such music signals, an amplifying peak of the sound is often increased due to extension of a dynamic range, thereby repeatedly applying excessive input signals to the speaker. These excessive input signals cause the coils C1 and C2 to move outside the widths W of the gaps G1, G2 such that sound distortion frequently occurs.

In addition, when the vibration amplitudes of the diaphragm 2 and bobbin 9 in the Y-axis direction become large due to the excessive input signals, the damper 15 impacts the upper surface of the ring-shaped pole piece 8*a*, or the lower end 9*a* of the bobbin 9 impacts the inner wall of a bottom l*b* of the frame 1, thereby causing frequent impact sounds. When an extremely large input is provided, the damper 5 and bobbin 9 may be damaged by these impacts.

In addition, when the vibration amplitude of the diaphragm 2 in the Y-axis direction becomes large, the amplitude cannot be absorbed by the suspension 4, and the semicylindrical portion of the suspension 4 is excessively stretched or contracted such that sound distortion is caused. Further, when extremely large input signals are intermittently provided, the suspension 4 may be damaged.

SUMMARY OF THE INVENTION

It is an object of the present invention to provide a speaker which can prevent the sound distortion caused in conventional speakers when excessive vibration of the diaphragm causes the coils to move outside of the gaps of the magnetic circuit.

It is another object of the present invention to provide damping to a diaphragm and coils of a speaker when an excessive input is provided so that they do not vibrate at an excessive amplitude.

It is further object of the present invention to prevent a damper and an end of a bobbin from striking a magnetic circuit and an inner surface of a frame when an excessive input signal is provided, and to prevent a suspension attached to an outer portion of the diaphragm from receiving an excessive deformation force.

According to an aspect of the present invention, there is provided a speaker which includes a diaphragm, coils cylindrically formed around the Y-axis constituting a vibration direction of the diaphragm and a magnetic circuit providing magnetic field crossing the coils, wherein a yoke made of a magnetic material and a magnet directly face each other at peripheral surfaces thereof around the Y-axis to form gaps, wherein the coils are positioned within the gaps, wherein the peripheral surfaces of the magnet is divided into a magnetized surface of the N pole and a magnetized surface of the S pole in the Y-axis direction, and wherein a displacement range of the diaphragm and coils is set so that the coil located in the gap facing the N pole can be displaced to a position extending over the magnetized surface of the S pole and such that the coil located in the gap facing the S pole can be displaced to a position extending over the magnetized surface of the N pole.

In the speaker as described above, the magnetized surface of the N pole and the magnetized surface of the S pole at the peripheral surface of the magnet may be arranged successively in the Y-axis direction. A magnet having the magnetized surface of the N pole may be formed separately from a magnet having the magnetized surface of the S pole, and these magnets may be arranged in contact or with a very small clearance therebetween in the Y-axis direction. However, it is preferable that a single cylindrical magnet is provided and the magnetized surface of the N pole and the magnetized surface of the S pole are provided on the peripheral surface of the magnet.

According to another aspect of the present invention, a speaker is provided in which the diaphragm is formed as a cone, an edge of the outer portion of the diaphragm is joined to a frame through a curved suspension, the coils are arranged on a bobbin attached to the central portion of the diaphragm, and the central portion is supported by a frame through a damper. A movable range of the coils allowed by the damper is set longer than a distance between ends of the coils in the Y-axis direction and the boundary between the magnetized surface of the N pole and the magnetized surface of the S pole when the coils are not energized.

Further, when the coils are not energized, a space between an end of the bobbin on which coils are wound and a bottom of the frame facing an end of the bobbin is set longer than a distance between ends of the coils in the Y-axis direction and the boundary between the magnetized surface of the N pole and the magnetized surface of the S pole.

Alternatively, when the coils are not energized, a distance between ends of the coils in the Y-axis direction and the boundary between the magnetized surface of the N pole and the magnetized surface of the S pole is set equal to or less than 0.7 times a width of the curved suspension.

In the magnetic circuit of the present invention, the magnetic surfaces of the magnet face the peripheral surface of the yoke, which is made of a magnetic material such as Mn—Zn ferrite, to form cylindrical gaps around the Y-axis. Furthermore, the magnet is divided into the magnetized surface of the N pole and the magnetized surface of the S pole in the Y-axis direction, and these magnetized surfaces are preferably provided successively or separated by a very narrow space in the Y-axis direction. Therefore, the magnetic flux density in the magnetic circuit is distributed smoothly and there are no sudden change points due to an extreme difference in the magnetic flux density, as in the prior art.

Accordingly, when the coils are displaced away from the magnetized surface of one magnetic pole to cause a portion thereof to be positioned over the magnetized surface of the other magnetic pole (that is, a position extending over the magnetized surfaces of both magnetic poles), no extreme deterioration in linearity is caused due to sudden change points. That is, since the magnetic flux density changes smoothly, the linearity does not change extremely due to the sudden change points when the coils are displaced, and a gentle damping force is provided from the other magnetic pole to a portion of the coils that is displaced to a position extending over the magnetic surface of the other magnetic pole. Thus, when the coils are displaced to a position extending over the magnetized surfaces of the other magnetic poles, no sound distortion is caused due to the sudden change points, and the amplitude of the diaphragm does not become extremely large because the coils receive a gentle damping force, thereby further preventing sound distortion. In addition, a deformed suspension provided at the outer portion of the diaphragm is not excessively stretched or contracted, thereby further preventing sound distortion.

Further, when the coils are displaced to a position extending over the magnetized surfaces of two magnetic poles, a dimensional margin is provided so that the damper does not strike the magnetic circuit. Also, when the coils are displaced to a position extending over the magnetized surfaces of two magnetic poles, a margin space of a sufficient size is provided so that the end of the bobbin does not strike the inner surface of the bottom of the frame. Thus, when an excessive input is provided, a damping force acts on the coils before the damper strikes the magnetic circuit, or before the end of the bobbin strikes the frame. Therefore, no impact sounds are caused due to the impacts of each of these parts, and there is no risk of the damper, bobbin and suspension being damaged.

BRIEF DESCRIPTION OF THE DRAWINGS

FIGS. 4A1, 4A2 and 4A3 are sectional views showing a magnetic circuit according to another embodiment of the present invention;

DESCRIPTION OF THE PREFERRED EMBODIMENTS

The preferred embodiments of the present invention will now be described.

Figure 1:
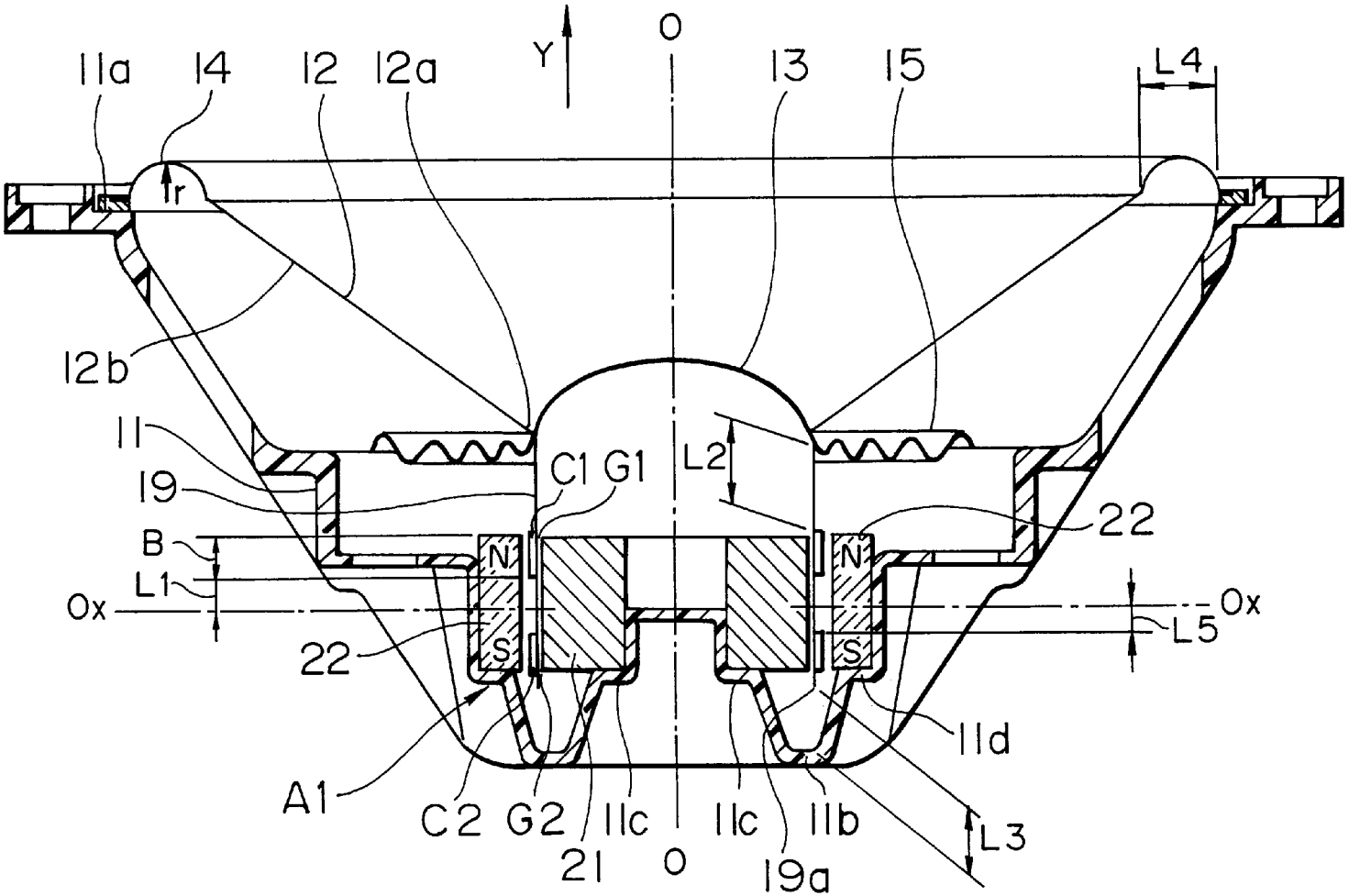
FIG. 1 is a sectional view showing an embodiment of a speaker according to the present invention.
Figure 5:
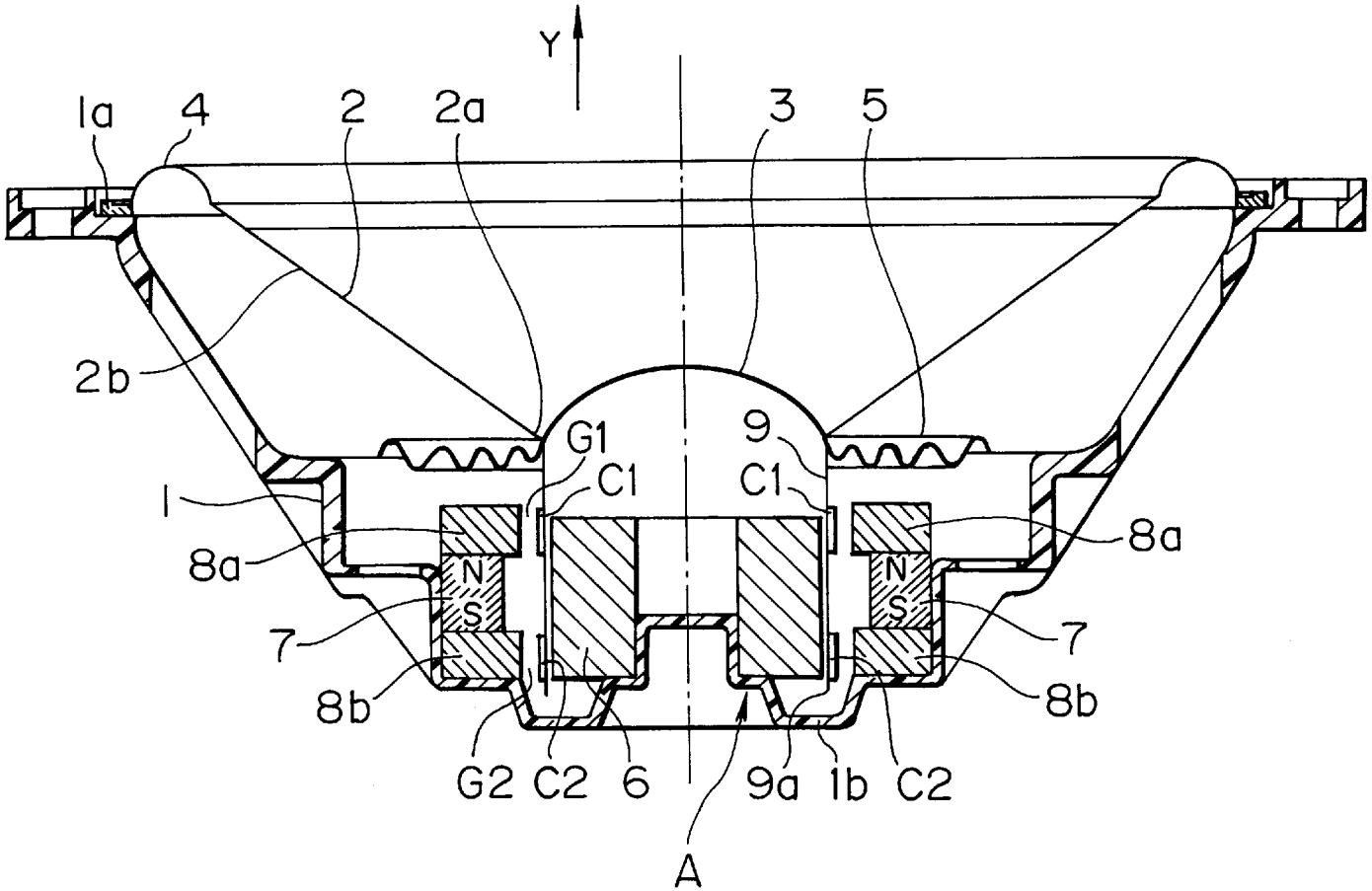
FIG. 5 PRIOR ART
FIG. 5 is a sectional showing a conventional speaker.

The basic structure of the speaker shown in FIG. 1 is similar to the speaker shown in FIG. 5.

In an embodiment shown in FIG. 1, however, a frame 11 is produced by injection molding of a plastic material such as ABS. Thus, the whole speaker is lightweight. Alternatively, the frame 11 may be produced by die casting of a lightweight alloy such as aluminum alloy or zinc alloy.

The speaker includes a cone-shaped diaphragm 12 which is made of a paper material. A spherical dome portion 13 is attached over an opening formed in a central portion 12*a* of the diaphragm 12. An outer portion 12*b* of the diaphragm 12 is joined to an edge 11*a* of the frame 11 through a suspension 14. The suspension 14 is provided separately from the diaphragm 12, and has a semi-circular (semicylindrical) cross sectional configuration with a predetermined radius of curvature r.

The outer periphery of the opening formed in the central portion 12*a* of the diaphragm 12 is supported by the frame 11 through a damper 15 which has a corrugated portion including concentric ridges formed around a central axis O—O of the speaker. A cylindrical bobbin 19 is attached to and extends from the central portion 12*a* in a direction opposite to the Y direction (see FIG. 1). Cylindrically wound coils C1 and C2 are fixedly connected to the bobbin 19.

The diaphragm 12, bobbin 19 and coils C1 and C2 are supported by the suspension 14 and the damper 15 such that they can vibrate along the central axis O—O (that is, in the Y-axis direction).

A magnetic circuit Al is provided between a bottom 11*b* of the frame 11 and the central portion 12*a* of the diaphragm 12.

In the magnetic circuit A1, a ring-shaped yoke 21 is provided on the inner peripheral side of the bobbin 19. The yoke 21 is formed of a magnetic material of high magnetic permeability such as a soft ferrite. A ring-shaped magnet 22 is provided outside the bobbin 19. The magnet 22 is a bonded magnet (plastic magnet) formed by bonding magnetic powder with resin, or may also be, for example, a sintered magnet. As shown in FIG. 1, the yoke 21 is located and fixed to a stepped portion 11*c* located on the inner peripheral side of the bottom 11*b* of the frame 11, and the magnet 22 is located and fixed to a stepped portion 11*d* located on the outer peripheral side of the bottom 11*b* of the frame 11.

Figure 3B:
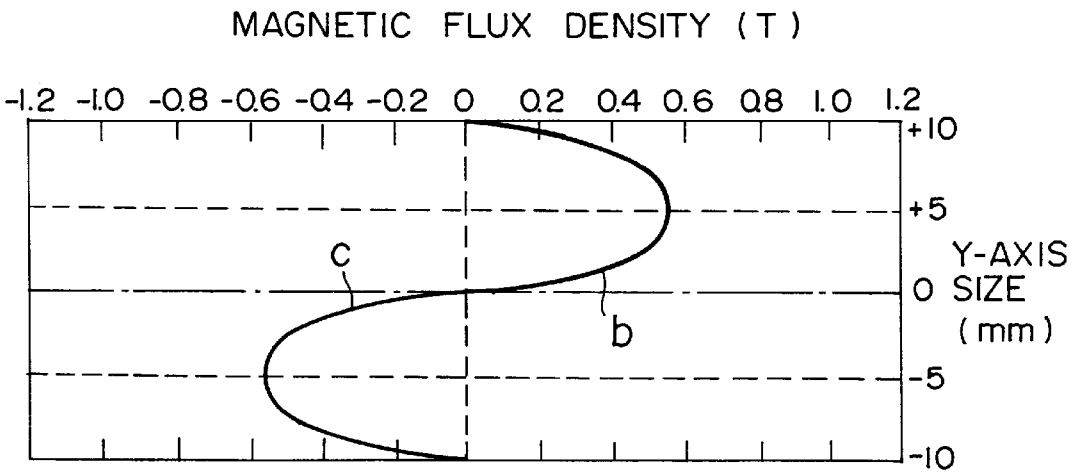
FIG. 3B is a diagram showing a distribution of magnetic flux density of the magnetic circuit shown in FIG. 3A.
Figure 3A:
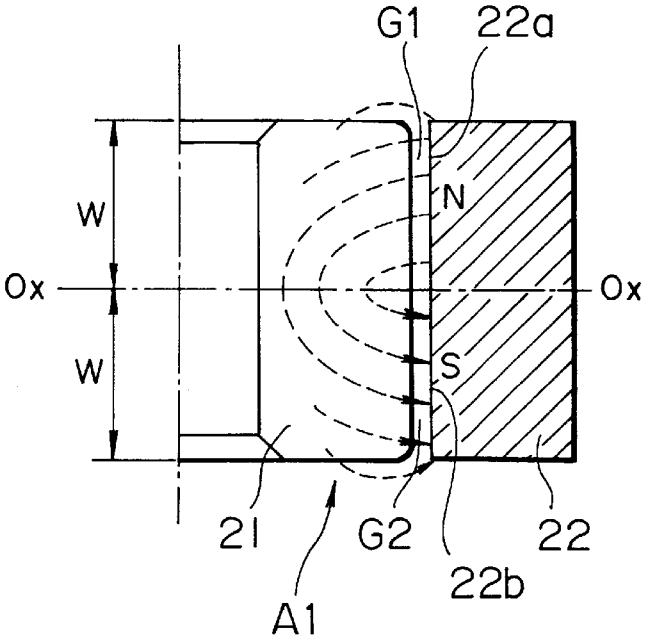
FIG. 3A is a sectional view showing a magnetic circuit of the speaker shown in FIG. 1.

As shown in FIG. 3A, the polarity of magnet 22 changes at a boundary line Ox—Ox which divides the magnet 22 into two equal parts in the Y-axis direction. That is, the peripheral surface (inner peripheral surface) facing the yoke 21 includes a first magnetized surface 22*a* located on the upper (Y direction) side of the boundary line Ox—Ox, which forms a north (N) pole, and a second magnetized surface 22*b* located on the lower side (opposite to the Y direction) which forms a south (S) pole. A gap G1 is formed between the magnetized surface 22*a* of the N pole and the peripheral surface (outer peripheral surface) of the yoke 21, and a gap G2 is formed between the magnetized surface 22*b* of the S pole and outer peripheral surface of the yoke 21. As shown in FIG. 1, when the coils C1 and C2 are not energized, the coil C1 is positioned within the gap G1 and the coil C2 is positioned within the gap G2.

As described above, the diaphragm 12, the bobbin 19 and the coils C1 and C2 are supported by the suspension 14 and the damper 15 in such a way that they vibrate in the Y-axis direction in response to a current applied to the coils C1 and C2. Also, a displacement range of the diaphragm 12, the bobbin 19 and the coils C1 and C2 in the Y-axis direction is set such that the upper coil C1 passes through the boundary line Ox—Ox so as to enter into the gap G2 in which the magnetized surface 22*b* of the S pole is facing the yoke 21, and so that the lower coil C2 passes through the boundary line Ox—Ox so as to enter into the gap G1 in which the magnetized surface 22*a* of the N pole is facing the yoke 21. That is, when the coil C1 or the coil C2 passes through the boundary line Ox—Ox and is displaced to a position extending over the magnetized surfaces 22*a* and 22*b* of both poles, the diaphragm 12, the bobbin 19 and the coils C1 and C2 still have a displacement margin.

Referring to FIG. 1, a distance along the axis O—O between the lower end (the end in the direction opposite to the Y direction; the end facing the bottom 11*b* of the frame 11) of the upper coil C1 and the boundary line Ox—Ox at the time of non-energization of the coil is indicated as L1, and a distance along the axis O—O between the damper 15 and the magnetic circuit A1, i.e. the upper end of the magnet 22, is indicated as L2. In accordance with the disclosed embodiment, L2 is preferably longer than L1, and more preferably, L2 has a length which satisfies the formula $L2 \geqq (L1+(1/3)B)$, where B is a width of each coil C1 and C2 measured in the Y-axis direction.

Further, a distance between the lower end (the end in the direction opposite to the Y direction; the end facing the bottom 11*b* of the frame 11) of the bobbin 19 and the inner wall of the bottom 11*b* of the frame 11 is indicated as L3. In accordance with the present invention, L3 is preferably longer than L1, and more preferably, L3 has a length which satisfies the formula $L3 \geqq (L1+(1/3)B)$.

In a speaker meeting the above requirements, when the diaphragm 12 and bobbin 19 are displaced in the direction opposite to the Y direction to cause the coil C1 to move beyond the boundary line Ox—Ox such that a portion of coil C1 is located adjacent the magnetized surface 22*b* of the S pole within the opposite gap G2, the damper 15 does not strike the magnetic circuit A1, i.e. the upper end of the magnet 22. Also, the lower end 19*a* of the bobbin 19 does not strike the inner surface of the bottom 11*b* of the frame 11. According to a preferable size, when the coil C1 goes beyond the boundary line Ox—Ox by only ⅓ of the width B thereof to reach the gap G2, the damper does not strike the magnet 22 and the bobbin 19 does not strike the inner wall of the bottom 11*b* of the frame 11.

When the suspension 14 is substantially semicylindrical in shape with a radius r, an allowable displacement of the diaphragm 12 in the Y direction and the direction opposite to the Y direction may be preferably set to 0.7 times or less of the width size L4 ($\approx 2\times r$). When the displacement of the diaphragm 12 is greater than 0.7 times L4, the suspension 14 is stretched or contracted to cause sound distortion. In this embodiment, the displacement is set such that the displacement of the diaphragm 12 is equal to or less than 0.7 times L4 when the coils C1 and C2 move beyond the boundary line Ox—Ox to reach magnetized surfaces of other magnetic pole.

That is, as shown in FIG. 1, the distance between the lower end of the coil C1 along the axis O—O and the boundary line Ox—Ox is indicated as L1, and the distance between the end of the coil C2 in the Y direction and the boundary line Ox—Ox is indicated as L5. In accordance with the present invention, both of L1 and L5 are equal to or less than 0.7 times L4. L1 and L5 are preferably shorter than 0.7 times L4, and more preferably, the distances obtained by the formulas $(L1+(1/3)B)$ and $(L5+(1/3)B)$ are less than or equal to 0.7 times L4. That is, when the coil C1 or C2 moves beyond the boundary line Ox—Ox to cause one third of the width B of the coils to face the magnetized surfaces of other magnetic poles, the displacement of the diaphragm 12 in the Y direction is equal to or less than 0.7 times L4 so that the suspension 14 is not excessively stretched or contracted.

The operation of the speaker will now be described.

FIG. 3B shows a change of a density of magnetic flux across gaps G1 and G2 in the magnetic circuit A1 provided in the speaker. In FIG. 3B, the horizontal axis represents the magnetic flux density (in tesla (T)) and the vertical axis represents a distance (mm) from the boundary line Ox—Ox in the Y-axis direction.

Figure 6B:
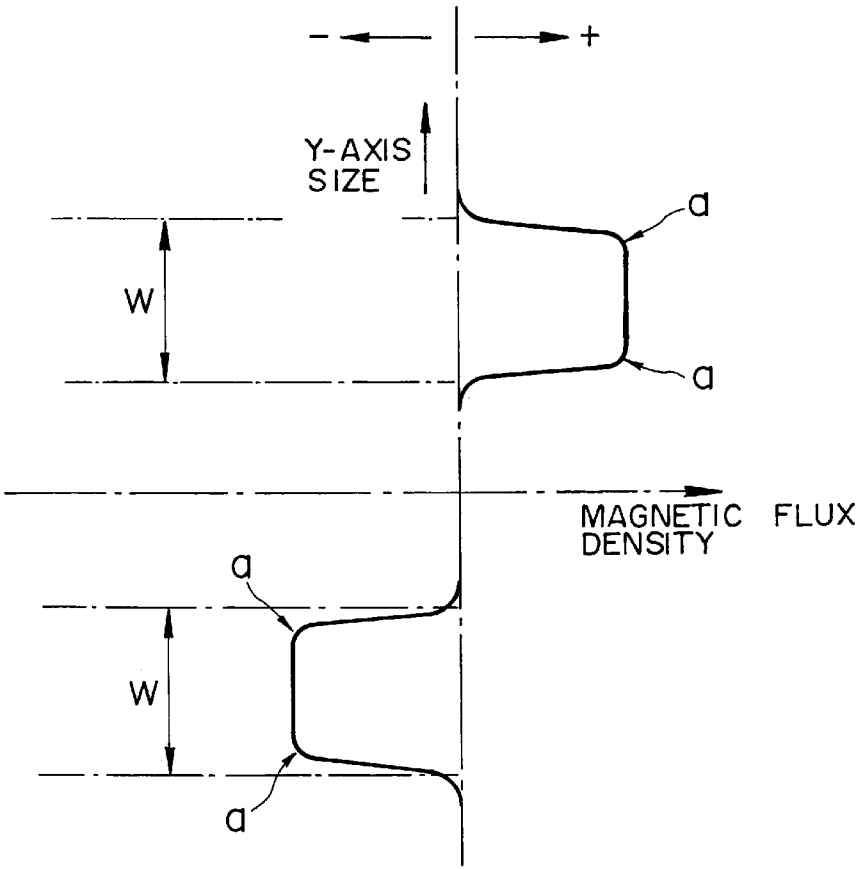
FIG. 6B PRIOR ART
FIG. 6B is a diagram showing a distribution of magnetic flux density of the magnetic circuit shown in FIG. 6A.
Figure 6A:
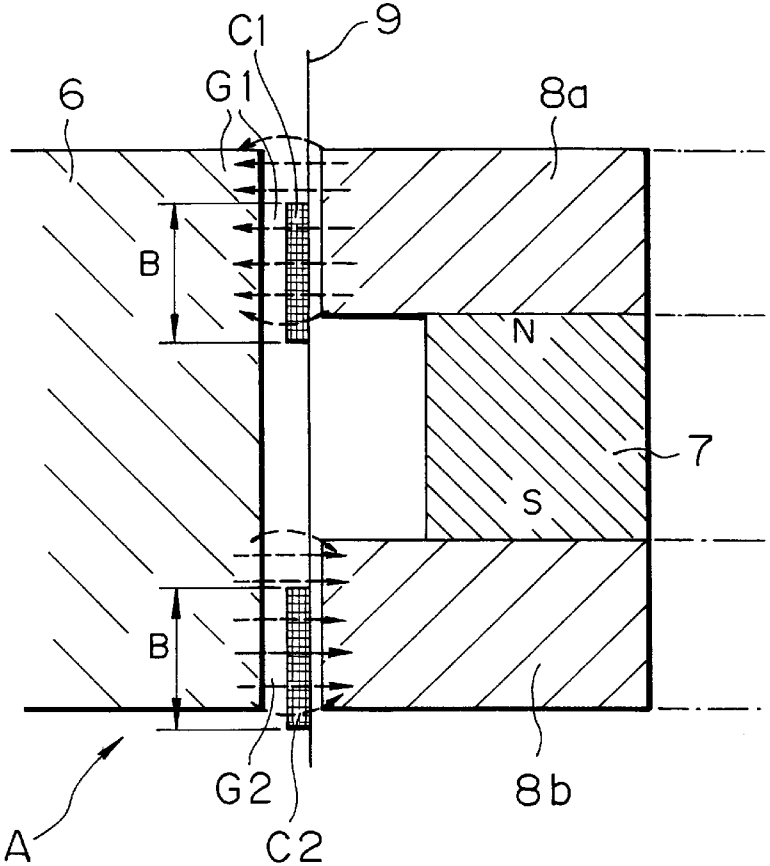
FIG. 6A PRIOR ART
FIG. 6A is a sectional view showing a magnetic circuit of the conventional speaker.

As indicated in FIG. 3A, the gaps G1 and G2 have a common, continuous radial width; that is, the magnetic circuit A1 does not include changes in the gap width between the gaps G1 and G2 as in the conventional magnetic circuit shown in FIG. 6A. Also, the magnetized surfaces 22*a* and 22*b* of the magnet 22 directly face the yoke 21. Moreover, the magnetized surface 22*a* of the N pole and the magnetized surface 22*b* of the S pole are connected at the boundary line Ox—Ox, and provided successively in the Y-axis direction. Thus, the magnetic flux density crossing the gaps G1 and G2 changes gradually, and no sudden change points "a" shown in FIG. 6B are present where there are great differences in magnetic flux density. Furthermore, the magnetic density of the N pole side and the magnetic density of the S pole side are represented by change lines extending continuously to left and right (+and−sides) at the boundary line Ox—Ox, as shown by "b" and "c" in FIG. 3B.

Figure 2:
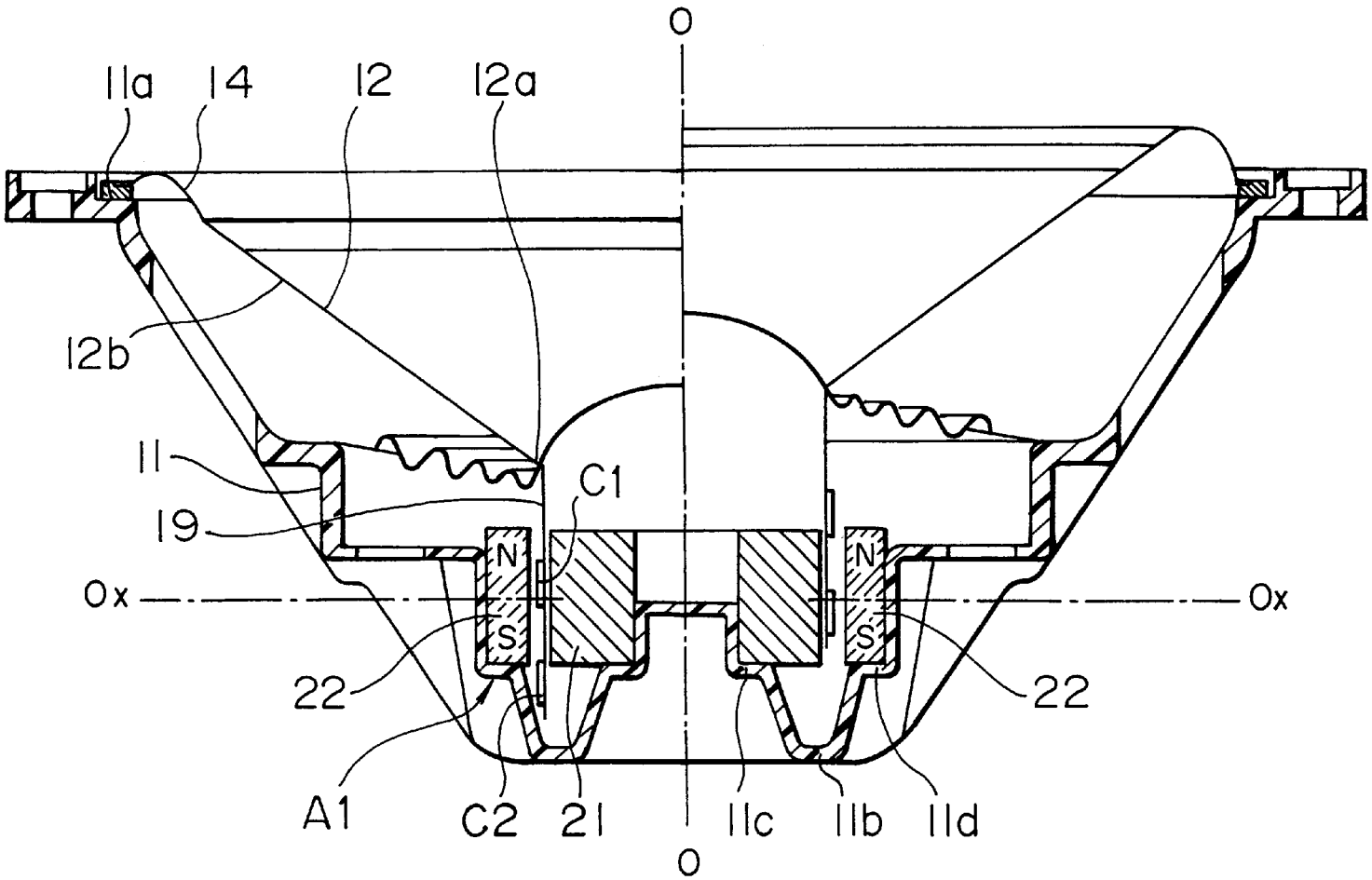
FIG. 2 is a split sectional view showing the operation of the speaker shown in FIG. 1 in which the left half and right half show states in which a diaphragm and coils are displaced in the different directions, respectively.

Accordingly, for example, as shown in the left half portion of FIG. 2, when the diaphragm 12 and bobbin 19 are displaced in the direction opposite to the Y direction due to vibration based on the energization to the coils C1 and C2 to cause a part of the lower end side of the coil C1 to move beyond the boundary line Ox—Ox so as to face the magnetized surface 22*b* of the S pole, or as shown in the right half portion of FIG. 2, when the diaphragm 12 and bobbin 19 are displaced in the Y direction to cause a part of the upper end side of the coil C2 to move beyond the boundary line Ox—Ox so as to face the magnetized surface 22*a* of the N pole, no sudden deterioration in linearity is caused due to the aforementioned sudden change points "a", and sound distortion can be controlled.

Furthermore, when the coil C1 or coil C2 moves beyond the boundary line Ox—Ox, a damping force acts on the coils C1 and C2 due to the influence of the magnetic flux in the reverse direction at the magnetized surfaces of the different magnetic poles. That is, a downward electromagnetic force acts on the coil C1 due to a current passing through the coil C1, and at this time, when the lower end portion of the coil C1 moves beyond the boundary line Ox—Ox to face the magnetized surface 22*b* of the S pole, an upward damping force is provided to the coil C1 due to the current passing through the coil C1 and magnetic flux of the S pole. Similarly, an upward electromagnetic force acts on the coil C2 due to a current passing through the coil C2, and at this time, when the upper end portion of the coil C2 faces the magnetized surface 22*a* of the N pole, a downward damping force acts on the coil 2 due to the current passing through the coil C2 and the magnetic flux of the N pole. As shown by "b" and "c" in FIG. 3B, the magnetic flux densities at the magnetized surfaces 22*a* and 22*b* near the boundary line Ox—Ox change in a smooth, continuous manner. Thus, the above-described damping force does not act suddenly, but acts gradually on the coil C1 or coil C2 according to the displacement of the coil C1 or coil C2.

Accordingly, when the diaphragm 12 and bobbin 19 are displaced greatly in the direction opposite to the Y direction, as shown in the left half of FIG. 2, and when the diaphragm 12 and bobbin 19 are displaced greatly in the Y direction, as shown in the right half of FIG. 2, the damping force acts on the coil C1 or coil C2, thereby controlling further displacement of the diaphragm 12 and bobbin 19. As a result, even if a peak of the voice current is high as a program source such as a compact disc is reproduced, the speaker shows an effect of controlling excessive displacement, thereby controlling the generation of excessive volume of a low-pitched sound and distortion of the low-pitched sound region.

In addition, in this embodiment, the diaphragm 12, the bobbin 19 and further, the damper 15 have a displacement margin at the point where a damping force acts on the coil C1 or coil C2, as described above. Thus, an excessive input can be effectively controlled by utilizing the damping force.

Furthermore, since the above-mentioned displacement margin is set, the damper 15 and the lower end 19*a* of the bobbin 19 does not strike other parts at the point where the damping force acts on the coil C1 or coil C2.

That is, as shown in the left half of FIG. 2, at the point where the coil C1 moves beyond the boundary line Ox—Ox and the damping force acts on the coil C1, the damper 15 does not strike the upper end of the magnet 22 of the magnetic circuit A1 and the lower end 19*a* of the bobbin 19 does not strike the inner wall of the bottom 11*b* of the frame 11. According to a preferable example, at the point where the coil C1 moves beyond the boundary line Ox—Ox and one third portion of the width B of the coil C1 faces the magnetized surface 22*b* of the S pole, the bobbin 19 does not strike the magnetic 22 and the lower end 19*a* of the bobbin 19 does not strike the inner wall of the bottom 11*b* of the frame 11.

In this way, the damper 15 does not strike the magnet 22 and the bobbin 19 does not strike the frame 11 at the point where the damping force acts on the coil C1, and more preferably, at the point where one third of the width B of the coil C1 faces the S pole and is not displaced further in the direction opposite to the Y direction. Thus, no impact sounds are caused due to collision of the parts by an excessive input. Also, the damper 15 and bobbin 19 are not damaged by collisions thereof.

Still further, according to this embodiment, the curved shape of the suspension 14 is set in such a way that it is not stretched or contracted at the point where the damping force acts on the coil C1 or coil C2.

That is, as shown in the left half of FIG. 2, at the point where the coil C1 moves beyond the boundary line Ox—Ox, or the coil C2 moves beyond the boundary line Ox—Ox as shown in the right half, to cause the damping force to act on the magnetized surfaces of different magnetic poles, the displacement of the diaphragm 12 in the Y direction or the direction opposite to the Y direction is equal to or less than 0.7 times the width size L4 of the suspension 14. Thus, at the point where the damping force acts on the coil C1 or coil C2, the suspension 14 is not stretched or contracted, thereby causing no sound distortion. According to a preferable example, at the point where the coil C1 or coil C2 moves beyond the boundary line Ox—Ox to cause one third of the width B of the coil C1 or coil C2 to face different magnetic poles, i.e. at the point where the bobbin 19 and diaphragm 12 are not displaced further, the displacement of the diaphragm 12 is equal to or less than 0.7 times L4.

Therefore, even though an excessive input is applied to the speaker, the curved portion of semicylindrical shape of the suspension 14 is not stretched or contracted, thereby preventing sound distortion and damage to the suspension 14.

According to another embodiment of the present invention, a speaker includes a magnetic circuit A2 having a structure shown in FIGS. 4A1, 4A2 and 4A3.

In the magnetic circuit A2 shown in FIGS. 4A1, 4A2 and 4A3, a pair of ring-shaped magnets 23 and 24 are arranged in the Y-axis direction at a portion facing the outer peripheral surface of the yoke 21. The magnets 23 and 24 differ from the magnet 22 of the first embodiment in that the magnets 23 and 24 include radial anisotropy. A magnetized surface of the N pole of one magnet 23 faces the yoke 21, and a magnetized surface of the S pole of the other magnet 24 faces the yoke 21. Also, a joining yoke 25 made of a magnetic material of high magnetic permeability such as soft iron and ferrite is provided on the outer peripheral surfaces of both magnets 23 and 24.

Figure 4A:
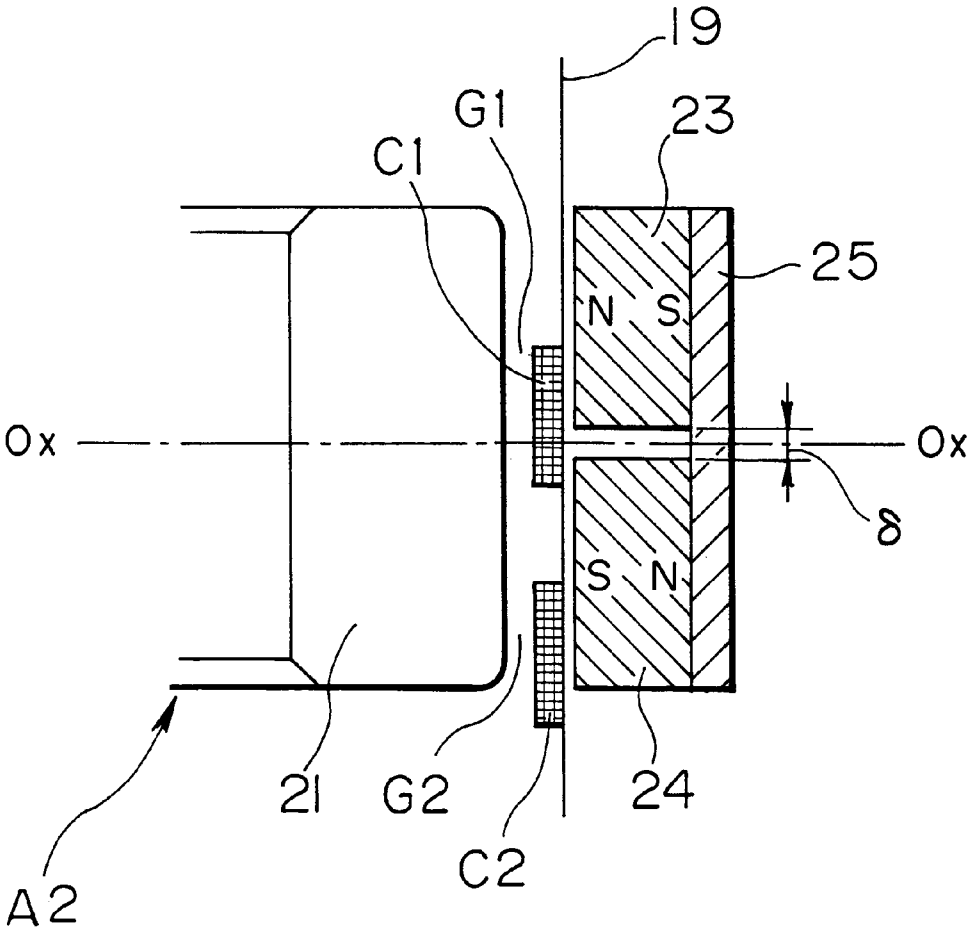
Figure 4B:
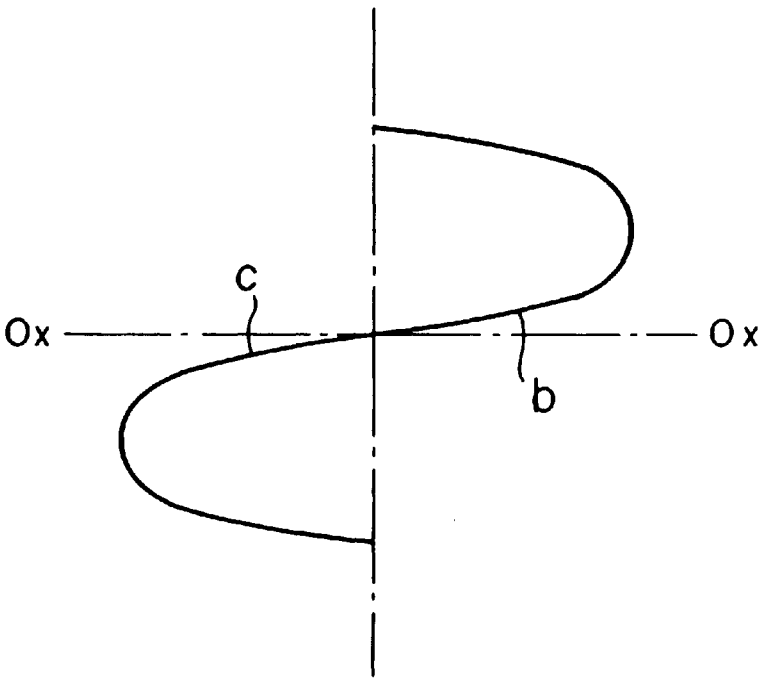
FIG. 4B is a diagram showing a distribution of magnetic flux density of the magnetic circuit shown in FIGS. 4A1, 4A2 and 4A3.
Figure 4B:
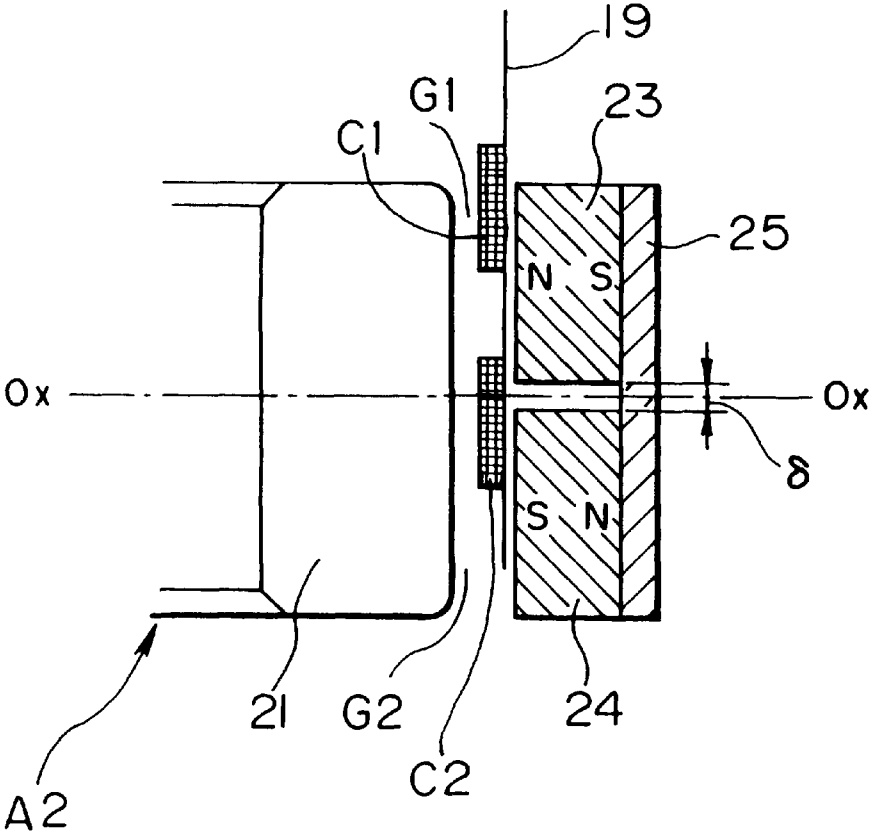

In this embodiment, as shown in FIG. 4B, the magnetic flux density changes smoothly in the gaps G1 and G2 which are divided in the Y-axis direction at the boundary line Ox—Ox, and no sudden change points "a" as shown in FIG. 6B are present. At the boundary line Ox—Ox, the magnetic flux density in the direction of the N pole and the magnetic flux density in the direction of the S pole can be represented by continuous change lines. When the magnetic circuit A2 is used, as in the case that the magnetic circuit A1 shown in FIG. 3A is used, a sudden deterioration in linearity of the displacement of the coil C1 or coil C2 is prevented so as to control sound distortion, and a proper damping force can be provided to the coil C1 or coil C2.

In the embodiment shown in FIGS. 4A1, 4A2 and 4A3, it is preferable that the magnets 23 and 24 aligned in the Y-axis direction are joined at the boundary line Ox—Ox and that a magnetized surface of the N pole and a magnetized surface of the S pole are provided successively in the Y direction.

However, the magnets 23 and 24 may be arranged with a slight clearance δ therebetween at the boundary line Ox—Ox. The clearance δ cannot be large, and is limited within a range where a change of the magnetic flux density in the different (left and right) directions can be represented by continuous change line b-c at the boundary line Ox—Ox as shown in FIG. 4B.

In the magnetic circuits A1 and A2, each yoke is provided inside the coils C1 and C2, and each magnet is provided outside the coils C1 and C2. However, in contrast with this, each magnet may be arranged inside the coils C1 and C2, and each yoke may be arranged outside the coils C1 and C2. In this case, L2 shown in FIG. 1 is a distance between the damper 15 and the upper end of the yoke 21.

In the embodiments described above, the speaker includes the cone-shaped diaphragm 12. However, the speaker may be of the type in which a sound vibration of the diaphragm vibrates a space within a horn provided separately at a sound-emitting surface side of the diaphragm.

As described above, according to the present invention, no sudden change points are present in the magnetic flux density of the magnetic circuit. Thus, an extreme deterioration in linearity due to the displacement of coils is eliminated, thereby preventing sound distortion.

In addition, when the coils are displaced from the magnetic poles with which the coils are facing to face the opposite magnetic poles, an adequate damping force is provided to the coils, thereby controlling effectively an excessive input.

Further, at the point where the damping force acts on the coils, the damper and bobbin do not strike the magnetic circuit and frame, thereby preventing a generation of an impact sound.

Still further, at the point where the damping force acts on the coils, tension and contraction of the suspension provided at the cone bottom of the diaphragm can be prevented and distortion of sound due to the tension and contraction can be also prevented.

What is claimed is:

1. A speaker comprising:

a frame;

a diaphragm having an outer portion attached to the frame, the diaphragm having a central portion;

a cylindrical bobbin attached to the central portion of the diaphragm, the cylindrical bobbin defining a central axis;

first and second coils attached to the bobbin and spaced apart in a direction parallel to the central axis;

an annular yoke made of a magnetic material; and an annular magnet structure;

wherein the yoke and magnet structure are concentrically arranged such that a gap is formed therebetween and a magnetic flux region is formed across the gap;

wherein the magnetic flux region includes a north (N) pole region and a south (S) pole region successively arranged in a direction parallel to the central axis;

wherein a portion of the first coil is positioned in the gap in the N pole region and a portion of the second coil is positioned in the gap in the S pole region; and wherein a displacement range of the diaphragm in a direction parallel to the central axis is set such that when the diaphragm is displaced in a first direction in a direction parallel to the axis, the portion of the first coil is moved into the S pole region, and when the diaphragm is displaced in a second direction in a direction parallel to the axis, the portion of the second coil is moved into the N pole region;

wherein said magnet structure comprises first and second magnets arranged successively in the direction parallel to the central axis, each of the first and second magnets having an anisotropy aligned radially with respect to the central axis, the anisotropies of the first and second magnets being opposite in direction such that the first magnet includes a peripheral surface facing said yoke which forms the N pole region, and the second magnet includes a peripheral surface facing said yoke which forms the S pole region.

2. A speaker according to claim 1, wherein the first and second magnets are connected to a joining yoke made of a magnetic material.

3. A speaker according to claim 1, wherein said diaphragm is cone-shaped and includes an outer edge joined to the frame through a curved suspension, and an inner edge attached to the bobbin and to the frame through a damper; and wherein the displacement range of the diaphragm is set longer than a distance between ends of the first and second coils in the direction parallel to the central axis and a boundary between the N pole region and the S pole region.

4. A speaker according to claim 1, wherein said diaphragm is cone-shaped and includes an outer edge joined to the frame through a curved suspension, and an inner edge attached to the bobbin and to the frame through a damper; and wherein a distance between an end of the bobbin and a surface of the frame in the direction perpendicular to the central axis is longer than a distance between ends of the first and second coils and a boundary between the N pole region and the S pole region.

5. A speaker according to claim 1, wherein said diaphragm is cone-shaped and includes an inner edge attached to the bobbin and to the frame through a damper, and an outer edge joined to the frame through a curved suspension having a width measured in a direction perpendicular to the central axis, the width being equal to two times a radius of curvature of the suspension; and wherein a distance between ends of the first and second coils in the direction parallel to the central axis and a boundary between the N pole region and the S pole region is less than or equal to 0.7 times the width of the suspension.

6. A speaker comprising:

a frame;

a diaphragm having an outer portion attached to the frame, the diaphragm having a central portion;

a cylindrical bobbin attached to the central portion of the diaphragm, the cylindrical bobbin defining a central axis;

first and second coils attached to the bobbin and spaced apart in a direction parallel to the central axis;

an annular yoke made of a magnetic material; and a magnet structure;

wherein the yoke and magnet structure are concentrically arranged such that a gap is formed therebetween and a magnetic flux region is formed across the gap;

wherein the magnetic flux region includes a north (N) pole region and a south (S) pole region successively arranged in a direction parallel to the central axis;

wherein a portion of the first coil is positioned in the gap in the N pole region and a portion of the second coil is positioned in the gap in the S pole region; and wherein a displacement range of the diaphragm in a direction parallel to the central axis is set such that when the diaphragm is displaced in a first direction along the axis, the portion of the first coil is moved into the S pole region, and when the diaphragm is displaced in a second direction along the axis, the portion of the second coil is moved into the N pole region; wherein said magnet structure comprises first and second magnet portions joined together and arranged successively in the direction parallel to the central axis, each of the first and second magnet portions having an anisotropy aligned radially with respect to the central axis, the anisotropies of the first and second magnet portions being opposite in direction such that the first magnet portion includes a peripheral surface facing said yoke which forms the N pole region, and the second magnet portion includes a peripheral surface facing said yoke which forms the S pole region.

7. A speaker according to claim 6, wherein said diaphragm is cone-shaped and includes an outer edge joined to the frame through a curved suspension, and an inner edge attached to the bobbin and to the frame through a damper; and wherein the displacement range of the diaphragm is set longer than a distance between ends of the first and second coils in the direction parallel to the central axis and a boundary between the N pole region and the S pole region.

8. A speaker according to claim 6, wherein said diaphragm is cone-shaped and includes an outer edge joined to the frame through a curved suspension, and an inner edge attached to the bobbin and to the frame through a damper; and wherein a distance between an end of the bobbin and a surface of the frame in the direction perpendicular to the central axis is longer than a distance between ends of the first and second coils and a boundary between the N pole region and the S pole region.

9. A speaker according to claim 6, wherein said diaphragm is cone-shaped and includes an inner edge attached to the bobbin and to the frame through a damper, and an outer edge joined to the frame through a curved suspension having a width measured in a direction perpendicular to the central axis, the width being equal to two times a radius of curvature of the suspension; and wherein a distance between ends of the first and second coils in the direction parallel to the central axis and a boundary between the N pole region and the S pole region is less than or equal to 0.7 times the width of the suspension.

10. A speaker comprising:

a frame;

a diaphragm having an outer portion attached to the frame, the diaphragm having a central portion;

a cylindrical bobbin attached to the central portion of the diaphragm, the cylindrical bobbin defining a central axis;

first and second coils attached to the bobbin and spaced apart in a direction parallel to the central axis;

an annular yoke made of a magnetic material; and first and second magnets concentrically arranged with said yoke such that a gap is formed therebetween and a magnetic flux region is formed across the gap, the first and second magnets being arranged successively in the direction parallel to the central axis, each of the first and second magnets having an anisotropy aligned radially with respect the central axis, the anisotropies of the first and second magnets being opposite in direction such that the first magnet includes a peripheral surface facing said yoke which forms an N pole region of the magnetic flux region, and the second magnet includes a peripheral surface facing said yoke which forms an S pole region of the magnetic flux region;

wherein a portion of the first coil is positioned in the gap in the N pole region and a portion of the second coil is positioned in the gap in the S pole region; and wherein a displacement range of the diaphragm in a direction parallel to the central axis is set such that when the diaphragm is displaced in a first direction along the axis, the portion of the first coil is moved into the S pole region, and when the diaphragm is displaced in a second direction along the axis, the portion of the second coil is moved into the N pole region.

11. A speaker according to claim 10, wherein the first and second magnets are connected to a joining yoke made of a magnetic material.

12. A speaker according to claim 10, wherein said diaphragm is cone-shaped and includes an outer edge joined to the frame through a curved suspension, and an inner edge attached to the bobbin and to the frame through a damper; and wherein the displacement range of the diaphragm is set longer than a distance between ends of the first and second coils in the direction parallel to the central axis and a boundary between the N pole region and the S pole region.

13. A speaker according to claim 10, wherein said diaphragm is cone-shaped and includes an outer edge joined to the frame through a curved suspension, and an inner edge attached to the bobbin and to the frame through a damper; and wherein a distance between an end of the bobbin and a surface of the frame in the direction perpendicular to the central axis is longer than a distance between ends of the first and second coils and a boundary between the N pole region and the S pole region.

14. A speaker according to claim 10, wherein said diaphragm is cone-shaped and includes an inner edge attached to the bobbin and to the frame through a damper, and an outer edge joined to the frame through a curved suspension having a width measured in a direction perpendicular to the central axis, the width being equal to two times a radius of curvature of the suspension; and wherein a distance between ends of the first and second coils in the direction parallel to the central axis and a boundary between the N pole region and the S pole region is less than or equal to 0.7 times the width of the suspension.

15. A speaker comprising:

a frame;

a diaphragm having an outer portion attached to the frame, the diaphragm having a central portion;

a cylindrical bobbin attached to the central portion of the diaphragm, the cylindrical bobbin defining a central axis;

first and second coils attached to the bobbin and spaced apart in a direction parallel to the central axis;

an annular yoke made of a magnet material; and an annular magnet structure;

wherein the yoke and magnet structure are concentrically arranged such that a gap is formed between each peripheral surface of the yoke and the magnet structure and a magnet flux region is formed across the gap;

wherein the peripheral surface of the magnet structure has a first magnetized surface which forms a north (N) pole and a second magnetized surface which forms a south (S) pole continuously arranged in a direction parallel to the central axis;

wherein the magnetic flux region includes a north (N) pole region facing the first magnetized surface and a south (S) pole region facing the second magnetized surface;

wherein a portion of the first coil is positioned in the gap in the N pole region and a portion of the second coil is positioned in the gap in the S pole region; and wherein a displacement range of the diaphragm in a direction parallel to the central axis is set such that when the diaphragm is displaced in a first direction in a direction parallel to the axis, the portion of the first coil is moved into the S pole region, and when the diaphragm is displaced in a second direction in a direction parallel to the axis, the portion of the second coil is moved into the N pole region.

16. A speaker comprising:

a frame;

a diaphragm having an outer portion attached to the frame, the diaphragm having a central portion;

a cylindrical bobbin attached to the central portion of the diaphragm, the cylindrical bobbin defining a central axis;

first and second coils attached to the bobbin and spaced apart in a direction parallel to the central axis;

an annular yoke made of a magnetic material; and a cylindrical magnet structure having an anisotropy aligned in the direction parallel to the central axis;

wherein the yoke and magnet structure are concentrically arranged such that a gap is formed between each peripheral surface of the yoke and the magnet structure and a magnetic flux region is formed across the gap;

wherein the peripheral surface of the magnet structure has a first magnetized surface which forms a north (N) pole and a second magnetized surface which forms a south (S) pole continuously arranged in a direction parallel to the central axis, with each portion of the magnet that extends radially outward beyond the first magnetized surface and the second magnetized surface having an anisotropy aligned radially with respect to the central axis;

wherein the magnetic flux region includes a north (N) pole region that faces the first magnetized surface and a south (S) pole region that faces the second magnetized surface;

wherein a portion of the first coil is positioned in the gap in the N pole region and a portion of the second coil is positioned in the gap in the S pole region; and wherein a displacement range of the diaphragm in a direction parallel to the central axis is set such that when the diaphragm is displaced in a first direction along the axis, the portion of the first coil is moved into the S pole region, and when the diaphragm is displaced in a second direction along the axis, the portion of the second coil is moved into the N pole region.

* * * * *